United States Patent [19]

Paschke et al.

[11] Patent Number: 4,918,878

[45] Date of Patent: Apr. 24, 1990

[54] PAY TELEPHONE ENCLOSURE

[75] Inventors: Robert A. Paschke, Prior Lake, Minn.; James A. Mosel, Eau Claire, Wis.; Charles H. Kratsch, Maple Grove, Minn.; Dean White; Travis H. Edinger, both of Chippewa Falls, Wis.

[73] Assignee: Electric Avenue, Inc., Edina, Minn.

[21] Appl. No.: 199,484

[22] Filed: May 27, 1988

[51] Int. Cl.[5] ..... E04H 14/00

[52] U.S. Cl. ..... 52/28; 52/27; 52/38; 52/79.4

[58] Field of Search ..... 52/36, 144, 145, 275, 52/282, 285, 27, 28, 38, 79.4, 236.1; 40/339, 336, 584, 625, 606, 210, 374, 626

[56] References Cited

U.S. PATENT DOCUMENTS

| | | | |
|---|---|---|---|
| Des. 263,102 | 8/1979 | George et al. . | |
| Des. 263,264 | 8/1979 | George et al. . | |
| 2,280,542 | 4/1942 | Rosendale | 52/261 X |
| 2,337,885 | 12/1943 | Hallam | 52/28 |
| 2,982,593 | 5/1961 | Chambers | 52/27 X |
| 3,247,332 | 4/1966 | McHugh | 52/27 X |
| 3,445,969 | 5/1969 | Sherron | 52/28 |
| 3,543,454 | 8/1968 | Danin | 52/79.4 X |
| 4,285,351 | 8/1981 | Nyffenegger | 194/215 X |
| 4,501,099 | 2/1985 | Boaz | 52/79.4 X |
| 4,706,399 | 11/1987 | Martin . | |
| 4,754,582 | 7/1988 | Cameron | 52/38 X |

OTHER PUBLICATIONS

Ohashi Japanese Publication 61-58368, 3/23/86.

Weinstein, "Smart Credit Cards: The Answer to Cashless Shopping", 1984 IEEE Spectrum, pp. 43–49.

*Primary Examiner*—David A. Scherbel

*Assistant Examiner*—Creighton Smith

*Attorney, Agent, or Firm*—Edward D. Manzo

[57] ABSTRACT

To provide for modular arrangements, a six-sided pay telephone housing is constructed using vertically oriented panels. The panels are connected to each other using fastenerless moldings that allow for rapid construction of the housing and easy replacement of the panels. Provision is also made in the housing for an electronic information display as well as replaceable advertising placards.

61 Claims, 6 Drawing Sheets

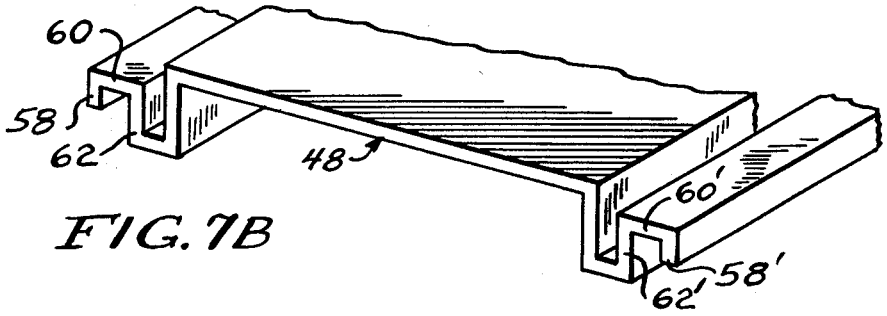
FIG. 7B
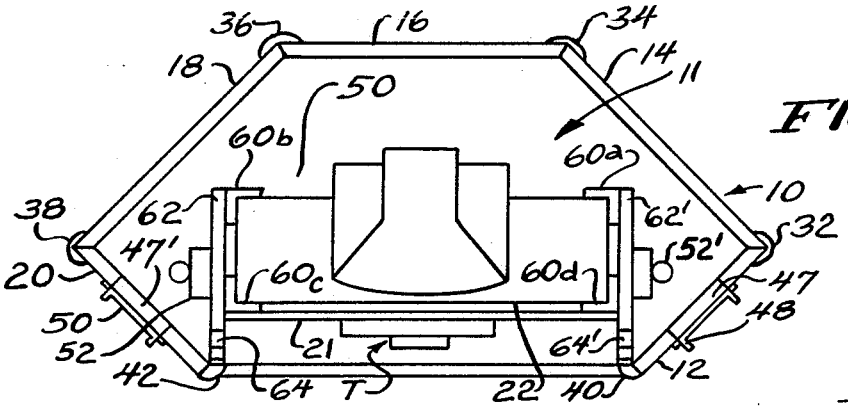
FIG. 8
FIG. 9
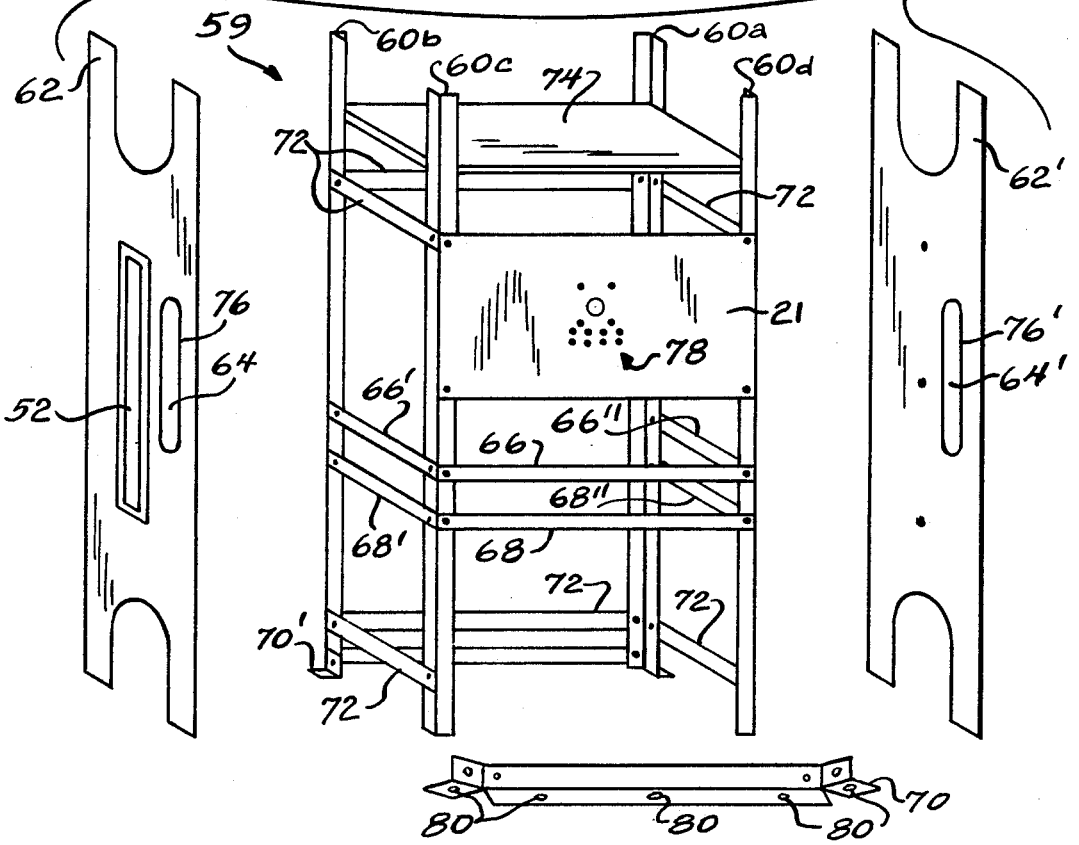

PAY TELEPHONE ENCLOSURE

FIELD OF THE INVENTION

The present invention relates to pay telephone housing structures. More particularly, this invention relates to housings for pay telephones that permit the display of information and advertising.

BACKGROUND OF THE INVENTION

Since its invention, the telephone has become increasingly accessible to an ever increasing segment of the population. Pay telephones facilitate the use of telephones on demand. Pay telephones may be found on streets and highways, in shopping malls, in restaurants and numerous other public establishments. Pay telephones are located in so many places that their presence if often taken for granted. Deregulation of the telephone industry has also made the service of providing pay telephones to the public a competitive business. There are currently a number of companies that place or lease pay telephones to various establishments. Typically, after arrangements have been made with the establishment owner, the pay telephone provider then installs a pay telephone at predetermined locations on the premises.

There are several well-known arrangements which may be used to mount or hold pay telephones, such as illustrated in U.S. Pat. No. 4,706,399 and in the assignee's co-pending design application entitled "Pay Telephone Enclosure", Ser. No. 200,083, filed May 27, 1988. A pay telephone may, for example, be simply mounted to a wall or post without any kind of housing or enclosure. Alternatively, a simple kind of housing may be provided around the telephone mounted to a wall or post. This housing may comprise partial panels to allow the caller a small measure of privacy, and/or may comprise a shelf to hold a telephone directory or provide a writing surface. The partial panels may protrude from the wall or post for a short distance past the front of the phone. One such simple housing may comprise a rectangular housing with top, bottom and side partial panels.

Another type of housing or enclosure is the well known telephone booth. The typical design of a booth comprises four walls, ceiling and perhaps a door. The booth itself may be mounted to a wall or post, or may stand alone. The telephone may be mounted along one of the walls of the booth or in one of the corners of the booth. At least a portion of one of the walls may be made of a glass or transparent material to provide visual access to the interior of the booth. These types of housings provide a large degree of privacy for those making the phone calls, especially if a door is provided. A shelf may also be provided to hold a telephone directory and to provide a writing surface. However, the typical booth requires a great deal of floor space which can limit the number of pay phone installations.

Further, a pay telephone housing may provide a number of different functions besides only housing a pay telephone. One such additional function may be an aesthetic function. Although pay telephone housings are not always considered "artworks," it is often desirable to design furniture and other functional fixtures to be aesthetically pleasing. For example, pay telephone housings of various colors are known.

This aesthetic function may also provide a pay telephone owner with a competitive advantage. Specifically, in a situation where a potential telephone caller must choose between one of several pay telephones, each such pay telephone owned by someone else, the potential telephone caller may be attracted to the telephone in the more attractive housing. Similarly, a potential pay telephone buyer/lessor may choose to deal with the pay telephone provider which offers the more aesthetic housings.

Since the areas in which the pay telephones are normally installed vary in physical dimensions, it is considered desirable to provide pay telephone structures that can be arranged with maximum flexibility. However, existing pay telephone enclosures provide only limited flexibility in this regard.

Another function that a pay telephone housing may have is as an advertising tool. Examples of such housings are disclosed in U.S. Pat. Des. No. 263,102 and Des. No. 263,264. The housing may have specific components that are directed to advertising. For example, the housing can include an electronic display positioned for viewing by the telephone callers, by passersby or both. An example of such a display is disclosed in the assignee's co-pending application entitled "Public Consumer Communication and Information System", Ser. No. 199,483, filed May 27, 1988. The ability of the housing to function as an advertising tool may also influence the revenue generated by the pay telephone. Advertising revenue may defray the cost of the pay telephone or generate revenue which would not otherwise be derived. One of the disadvantages of current pay telephone enclosures is that it is difficult and expensive to change the advertising components periodically.

One concern for owners of pay telephones with housings is maintenance. Pay telephones and housings typically undergo a great deal of wear and tear due to placement in public places. Also, since pay telephones are often located in a public area in which vandalism is a concern, therefore, repair and maintenance of the housing is an important consideration. Further, quick and easy maintenance cuts costs for the owner of the pay telephone and the housing.

Costs to the pay telephone provider can also be reduced when the design of the housing allows for quick setup and takedown. Since the pay telephone enclosures are generally set up when the lease contract for the pay telephone begins and taken down when the lease contract for the pay telephone is ended, it is an advantage to provide a readily installable housing.

SUMMARY OF THE INVENTION

It is accordingly a general object of the invention to provide a pay telephone housing that is easily assembled and easily repaired.

It is another object of this invention to provide a pay telephone housing that is aesthetically pleasing.

It is a further object of the invention to provide a pay telephone housing with components which also function as an advertising tool.

It is an additional object of the invention to provide a pay telephone housing capable of being clustered in various modular arrangements with at least one other of the same type of pay telephone housing.

In accordance with the present invention, a pay telephone housing is provided which is made up of a plurality of panels, each panel having a predetermined width. The panels have predetermined widths so that a plurality of these housings may be clustered adjacent to each other in predetermined arrangements.

In accordance with one aspect of the invention, a pay telephone housing is provided which has a number of vertically arranged panels to provide a partial enclosure around the interior of the housing. The pay telephone is supported in the interior of the housing. A top panel is placed across the upper ends of the panels. In one embodiment of the invention, seven panels are used for the housing. Each of the panels is at least 72 inches long and 11 inches wide. The housing can also includes a telephone bookshelf. The panels are connected to one another to form the housing with moldings that secure one panel to another panel. To more securely attach the panels to each other, each panel has a groove along at least a portion of the edge being connected to the molding and the molding has a projection along at least a part of its length that fits into the grooves on the panel.

At least one of the panels can also support an advertising placard. The advertising placard can be made of a translucent material and a light fixture is located within the interior of the housing and adjacent to the advertising placard.

In accordance with another embodiment of the invention, the housing described above can also include an electronic display mounted within the interior of the housing. The display can be a video monitor or a multiline electronic display.

In accordance with another aspect of the invention, an advertising placard is provided for use with a pay telephone housing. A translucent panel onto which an advertisement has been incorporated is received and held by a panel holder that in turn is secured to the housing. The advertising panel can be either transparent or translucent. The translucent panel is joined to the panel holder in a registering relationship. The translucent panel can readily be placed into and removed from the panel holder by sliding the translucent panel into and out of the panel holder. A light fixture is also located within the housing opposite the side of the translucent panel and adjacent to the translucent panel. The light fixture may be a fluorescent lamp with a length substantially equal to the longest dimension of the placard. A transparent sheet can also be positioned substantially parallel to and in front of the side of the translucent panel on which the advertisement has been incorporated.

These and other objects of the invention will become more apparent from the foregoing detailed description with reference to the drawings. Throughout the drawings, like reference numerals refer to like elements.

BRIEF DESCRIPTION OF THE DRAWINGS

FIG. 7B is a top sectional view of the panel in FIG. 7;

FIG. 8 is a top view of the inside of the housing along the lines 8—8 in FIG. 2;

FIG. 9 is a partial exploded view of the interior frame support structure of the housing of FIGS. 1 and 2.

DETAILED DESCRIPTION OF THE INVENTION

Referring to the Figures generally and in particular to FIGS. 1–5, there is illustrated the preferred embodiment of the invention which is a structure generally indicated at 10 for housing a pay telephone.

Figure 3:
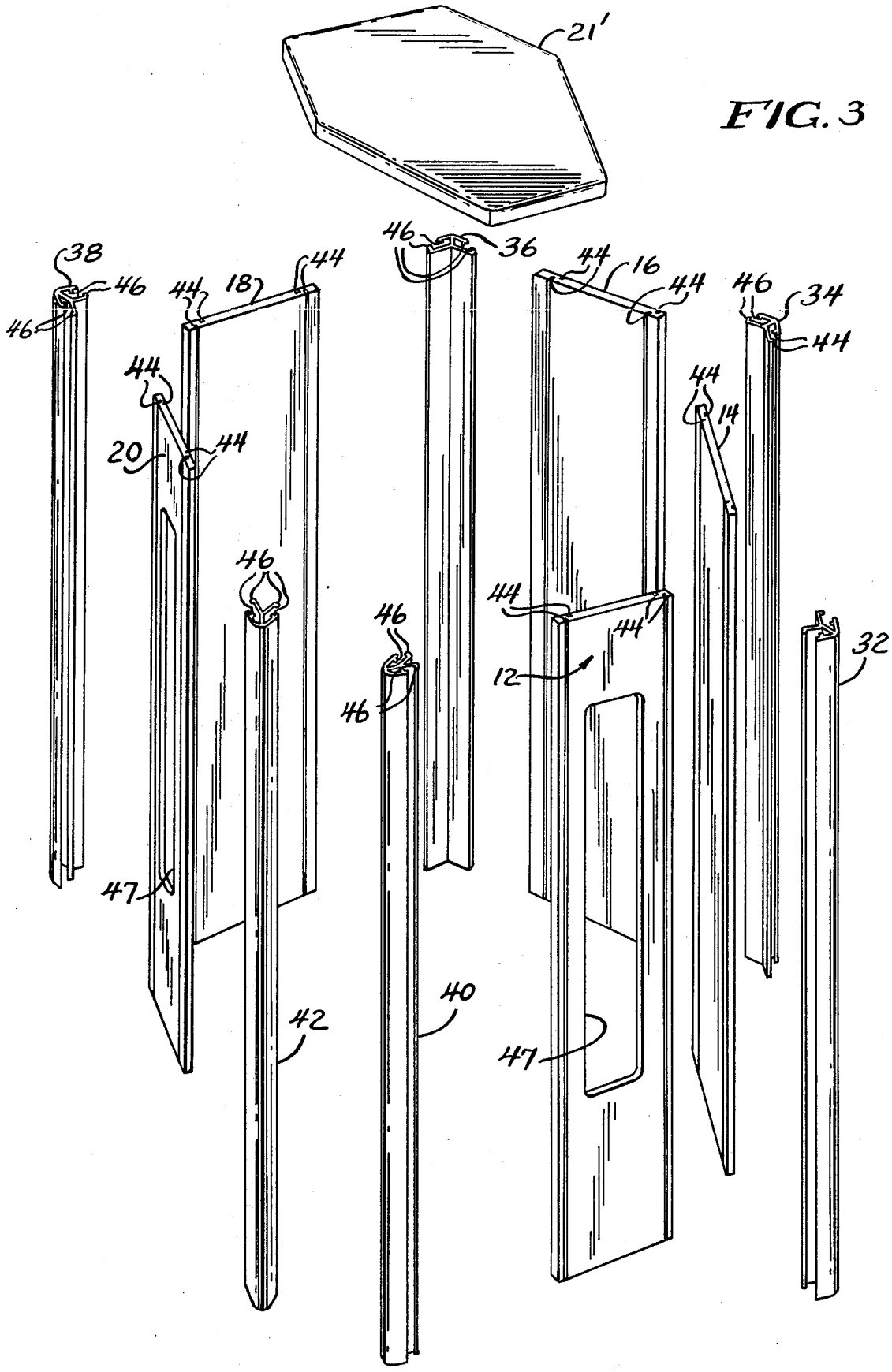
FIG. 3 is an exploded view of the outer elements of the housing of FIG. 1.

Housing 10 includes a number of vertically arranged planar panels 12, 14, 16, 18 and 20 as shown in FIG. 3. Panel 16 may also be characterized as a back panel to housing, opposite from the front of housing 10. As used herein, the panels preferably used in this invention have two major dimensions and one minor dimension. The two major dimensions correspond to the length (or height) of the panel and the horizontal width of the panel. The minor dimension corresponds to the thickness of the panel. In the preferred embodiment illustrated, five vertically aligned panels 12, 14, 16, 18 and 20 are provided. Panels 12–20 are connected together in a side-by-side arrangement to provide a partial enclosure around a telephone T. An interior portion, generally indicated at 11, includes a planar support member 21 secured by at least one of the panels. This telephone support member 21 is generally parallel to the back panel 16. Panels 12–20 can be made from any known materials, such as wood, particle board, plastic or any other material which may be formed into sheets. Housing 10 can comprise a frame, discussed below, made of steel or other rigid material for providing additional support to housing 10 and interior portion 11. For example, the frame may be attached to the floor to prevent housing 10 from being tilted over.

Figure 1:
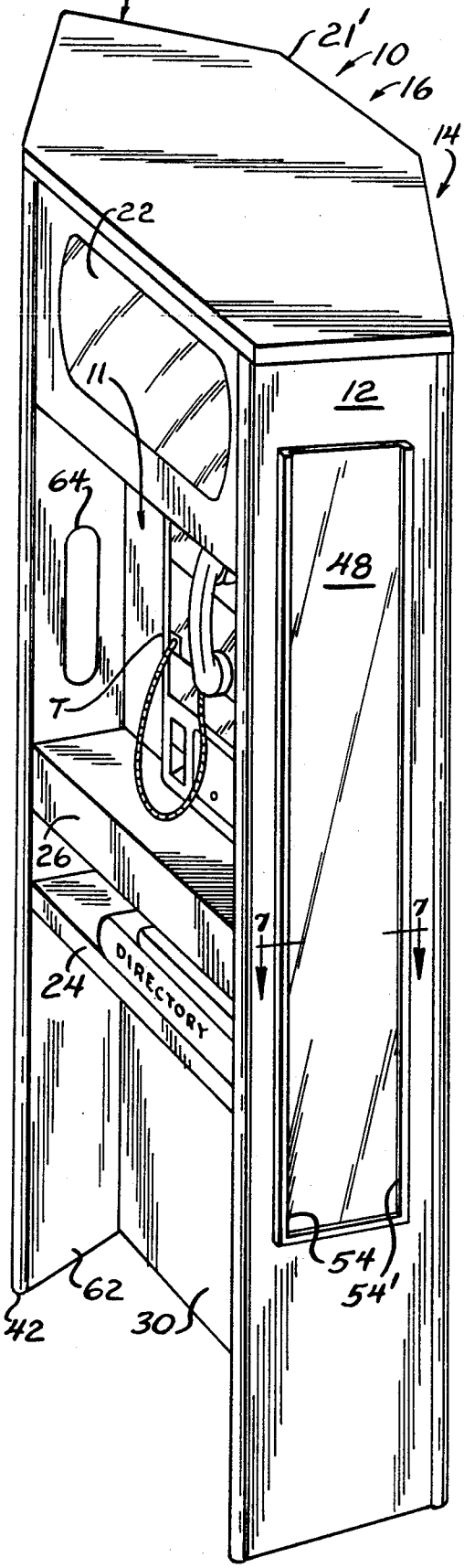
FIG. 1 is a perspective view of a pay telephone housing.
Figure 2:
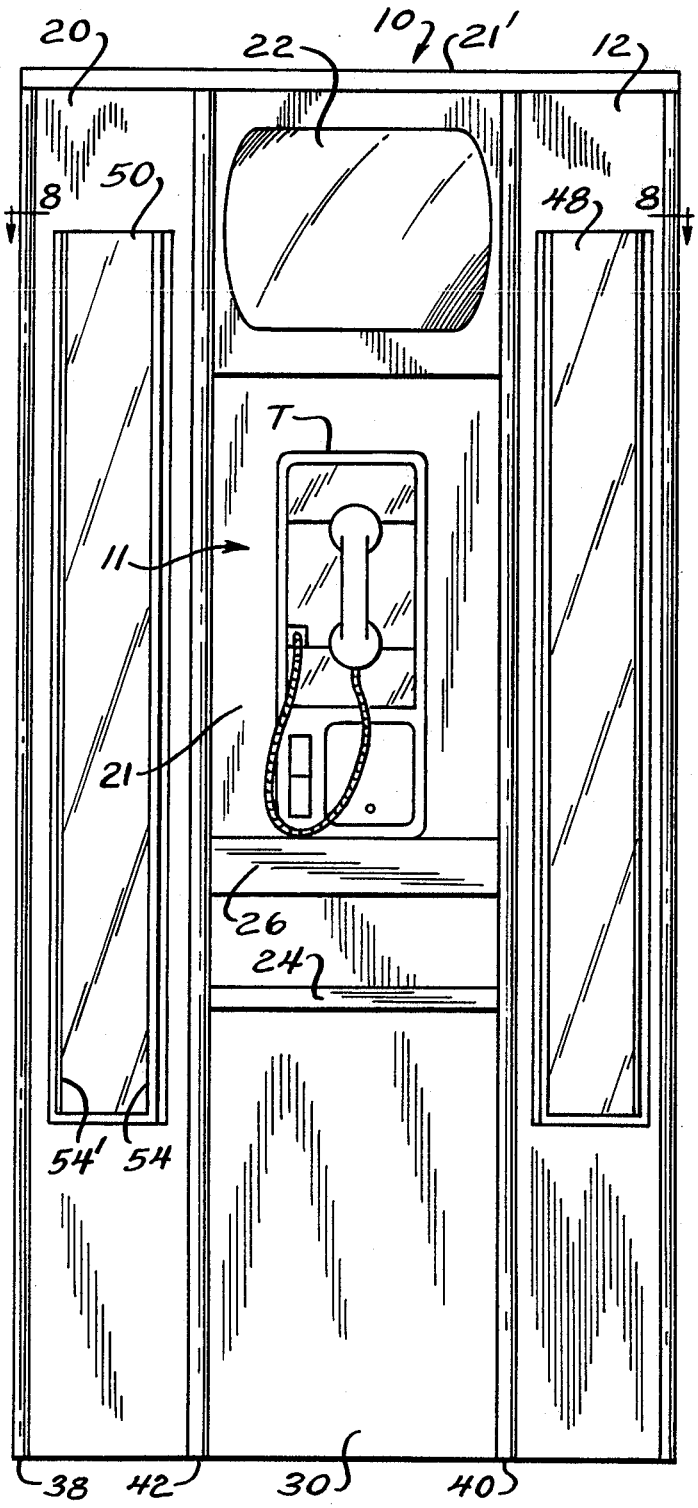
FIG. 2 is a front view of the housing of FIG. 1.

Further, an electronic information display indicated generally at 22 is also be located within the interior of housing 10. The display 22 can comprise a video monitor or, alternatively, a multi-line electronic display. As illustrated in FIGS. 1 and 2, the display 22 is positioned above telephone T. Display 22 can be used to provide a caller or a passerby with predetermined advertising or other information. Housing 10 also includes two shelves 24 and 26 located below telephone T. The space between shelves 24 and 26 form a holding area for telephone directories or the like. Further, shelf 26 includes a writing surface 28 upon which paper or the like may be supported while a caller (not shown) writes down information. Below shelf 24, a panel 30 is located and is detachable (not shown) from the rest of housing 10. Panel 30 may be removable to provide access to the electronic controls for the telephone T or monitor 22.

Figure 5:
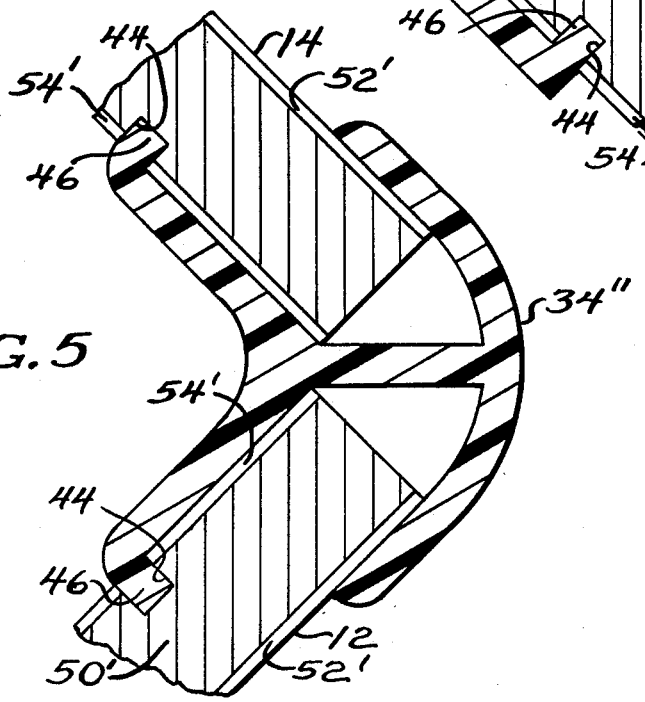
FIG. 5 is a top view of another molding of FIG. 3 holding two panels at a predetermined angle and further showing another arrangement of the panels in which the edges of the panels come to a point.

FIG. 3 provides an exploded view of the exterior elements of housing 10 including panels 12–20 which are secured together by a number of moldings 32, 34, 36 and 38. The use of moldings 32–38 provides for a housing constructed with panels 12–20 without fasteners such as nuts and bolts, screws or the like. These fastenerless moldings 32–38 allow for rapid construction of the housing and easy replacement of the panels. Another two moldings 40 and 42 are secured to the outer vertical edges of panels 12 and 20, and preferably to frame side panels 62' and 62 (see FIG. 8), respectively, and provide users with protection from the edges of panels 12 and 20 located on opposite sides of the opening to telephone T formed by the panels 12 and 20. Moldings 32–42 can be made of rubber, plastic or the like and are preferably manufactured by an extrusion process. As illustrated in FIG. 5, molding 34'' is fashioned with rounded corners on both the sides exposed to the public and the sides not exposed to the public.

A top panel 21 is secured across the top edges of panels 12–20.

To give housing 10 its unique six-sided shape, panels 12–20 do not have the same horizontal dimension or width. Each of panels 12–20 are, however, all of substantially the same length. The width of panel 12 is substantially the same as panel 20, and the width of panel 14 is substantially the same as panel 18.

Figure 4:
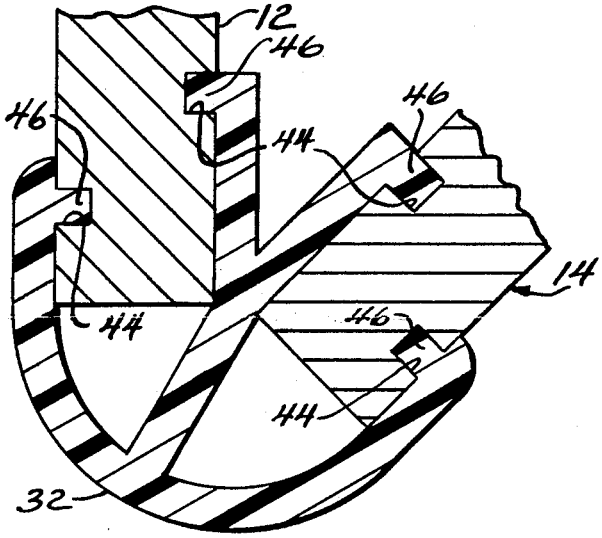
FIG. 4 is a top view of one of the moldings shown in FIG. 3 for securing two panels at a predetermined angle.
Figure 4A:
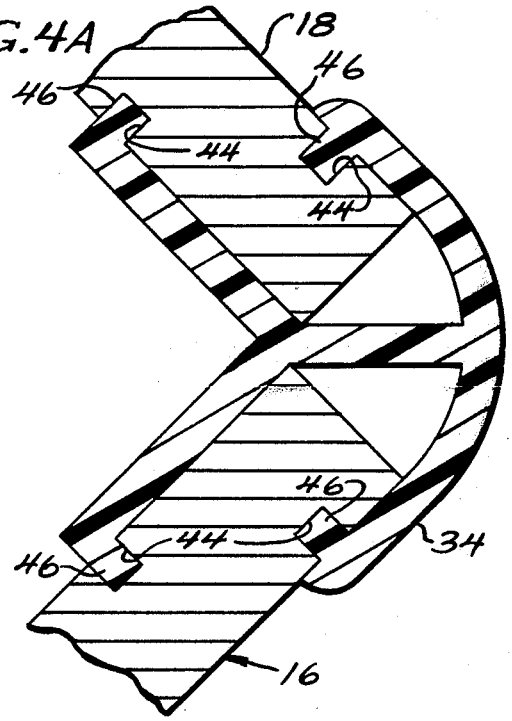
FIG. 4A is a top view of one of the moldings of FIG. 4 holding two panels at another predetermined angle.
Figure 4B:
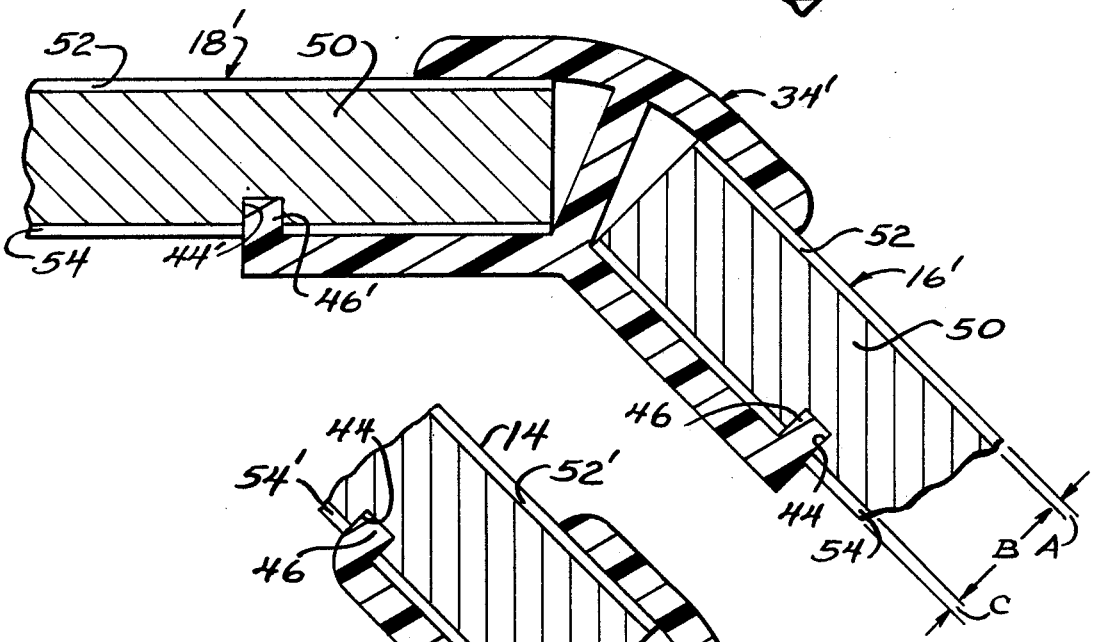
FIG. 4B is a top view of one of the moldings of FIG. 4 holding two panels at another predetermined angle.

Preferably, the panels 12–20 are of a composite construction, as illustrated in FIGS. 4B and 5. Panels 16' and 18' in FIG. 4B, for example, are formed with core board 50, preferably particle board. The grade of particle board may be 45# Industrial Grade particle board. Core board 50 has a thickness B in the range of about one-fourth to three-fourths inches, preferably about one-half inch. On the "outside" surface of panels 16' and 18', the side exposed to the public, a plastic layer 52 is provided. Plastic layer 52 is made from one of several well-known plastic or plastic-like materials which are formable as sheets. Preferably, plastic layer 52 is made of high pressure plastic, such as rigid vinyl. Plastic layer 52 has a thickness A, in the range of about one-hundredth to six-hundredths of an inch, preferably about three-hundredths of an inch. Opposite the side of panels 16' and 18' with plastic layer 52, rigid paper layer 54 is provided. Rigid paper layer is made from any one of several well-known paper or paper-like materials which are formable as sheets. Rigid paper layer 54 has a thickness C, in the range of about one-hundredth to three-hundredths of an inch, preferably about two-hundredths of an inch.

The method of securing together of the panels 12–20 will now be discussed. Moldings 32, 34, 36 and 38 have predetermined angles of orientation, as seen in FIGS. 4–5. Moldings 34 and 36 form a wider angle than moldings 32 and 38 to accommodate the varying widths of the panels 12–20 to complete the partial enclosure of telephone T.

Figure 6:
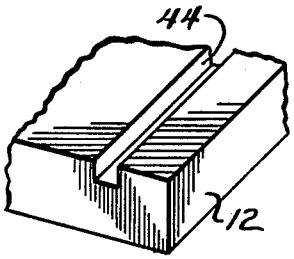
FIG. 6 is a perspective sectional view of one of the panels showing a groove.
Figure 10D:
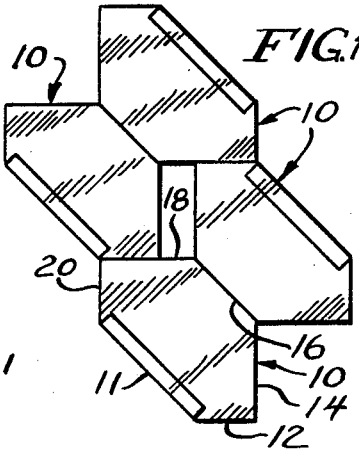
Figure 7A:
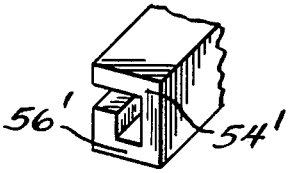
FIG. 7A is a top sectional view of the right panel holder in FIG. 7.
Figure 10C:
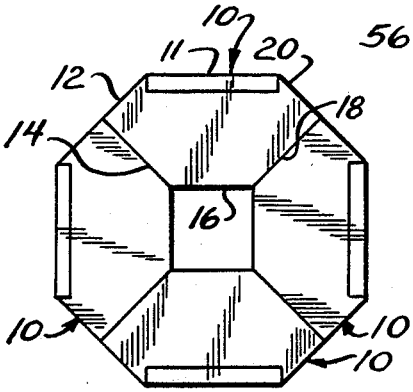
Figure 10F:
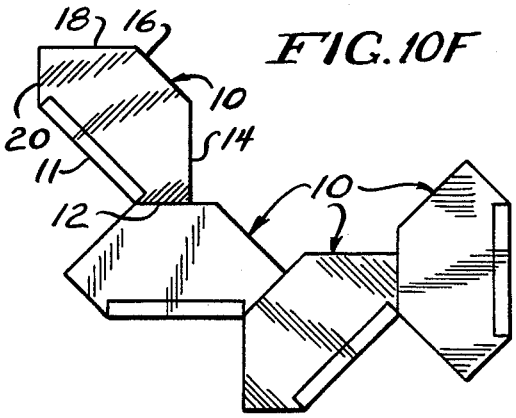
Figure 10E:
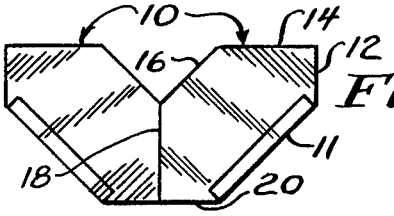

The panels 12–20 are configured with grooves 44 along each of their outer surfaces. Grooves 44 can be formed either on both sides of panels 12–20 as illustrated in FIGS. 4–4A, or preferably are formed on only one side of panels 12–20, as illustrated in FIGS. 4B–5. Preferably, only one groove is provided, as in FIGS. 4B and 5. A closer view of a side panel 12, for example, with groove 44 is illustrated in FIG. 6. Correspondingly, moldings 32–42 are provided with projections as shown at 46. Moldings 32–42 can be formed with either four projections 46 as in FIGS. 4–4A or with two projections 46 as in FIGS. 4B and 5. Projections 46 extend along at least a portion of the length of moldings 32–42. As can be seen generally in FIGS. 4–5, the grooves 44 receive projections 46. Moldings 32–42 are provided with either two or four projections depending on whether grooves 44 have been formed on either one side or two sides of the panels 12–20. As shown in FIGS. 4–4A, the panels 12–20 have been provided with grooves 44 on both sides and moldings 32–38 have been provided with four projections 46. In FIG. 5, the panels 12–20 are alternatively provided with one groove 44 on one side of the panels 12–20 and moldings 32–38 are alternatively provided with two projections 46.

For projections 46 to be received securely into grooves 44, the length of projections 46 should be equal or less than the depth of grooves 44.

By using this system of connecting the panels 12–20 with moldings 32–38, damaged panels may be easily replaced. Specifically, all that is required is to remove the top panel 21, slide the existing panel out of the moldings and slide in the new panel. In the same manner, the panels 12–20 and moldings 32–42 provide a construction for housing 10 which may be quickly set up or taken down.

The moldings 40 and 42 as illustrated in FIG. 3 have two grooves and two projections. Moldings 40 and 42 are used to provide user protection from the edges of panel 12 and 20 and are not used to connect one panel to another.

Figure 7:
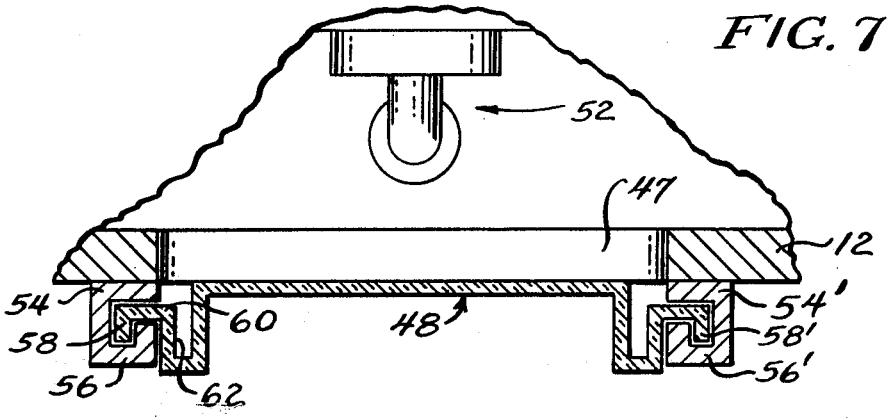
FIG. 7 is a top sectional view of a portion of FIG. 1 along the lines 7—7.
Figure 10A:
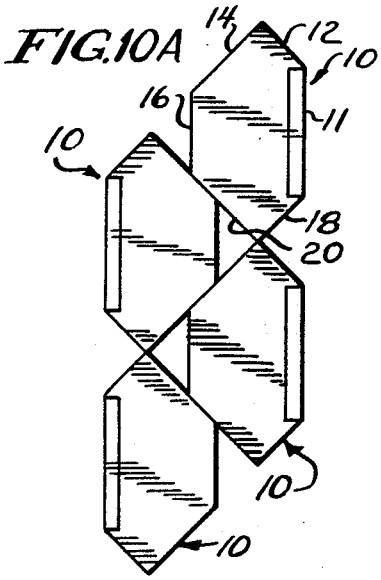
FIGS. 10A–10F illustrate various configurations of the housing shown in FIGS. 1 and 2.
Figure 10B:
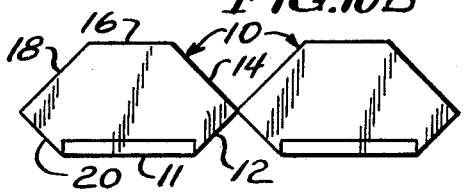

As shown in FIG. 3, a portion of the two panels 12 and 20 includes apertures 47 and 47'. Apertures 47 and 47' can have a length of 41 inches. A pair of translucent display panels 48 and 50 shown in FIGS. 1 and 2 are used to cover apertures 47 and 47'. Display panels 48 and 50 can be printed with a design, preferably an advertising message or indication of the presence of the telephone T. Display panels 48 and 50 can be constructed from a variety of materials, preferably a material which is capable of receiving the desired message and is aesthetically pleasing. Display panels 48 and 50, for example, are preferably constructed from a translucent material. Display panels 48 and 50 are preferably made of white translucent butyrate, having a thickness in the range of about one-twentieth to three-tenths of an inch, preferably about one-tenth of an inch. As shown in FIG. 7, a light fixture 52 is secured within the housing 10 opposite the side of display panel 48 (and likewise, for middle panel 50) exposed to the public. When illuminated, light fixture 52 provides back lighting for the translucent display panels 48 and 50. In the preferred embodiment of the invention, the light fixture 52 has a length of 41 inches.

Display panels 48 and 50 can be attached to the panels 12 and 20 in a number of ways. Display panels 48 and 50 can, for example, be screwed or glued to panels 12 and 20. However, the preferred method for securing display panels 48 and 50 is illustrated in FIGS. 7–7B. Specifically, display panel 48 is secured on both sides of its length by a pair of panel holders 54 and 54' which are permanently attached to the panels 12 and 20. Panel holders 54 and 54' retain the display panel 48 in a registering relationship. Panel holders 54 and 54' include J-shaped portions 56 and 56' which are engaged with elements 58–62' of display panel 48. The elements 58–62' are integral with display panel 48. The panel holders 54 and 54' form a track which is effective to secure display panel 48. Thus, display panel 48 may be placed into or removed from panel holders 54 and 54' by sliding display panel 48 vertically into and out of panel holders 54 and 54'. This alternative means of securing provides a rapid method for replacing display panels 48 and 50. Therefore, if display panels 48 and 50 contain advertising messages, these messages may be readily changed.

The construction of the interior portion of the housing 10 which is generally indicated at 11 will now be discussed in greater detail. One example of an interior portion 11 construction is illustrated in FIGS. 8 and 9. In FIG. 8, a top view of housing 10 and interior 11 along the lines 8—8 in FIG. 12 is illustrated. However, FIG. 8 varies from FIG. 2 in that monitor 22 is recessed slightly towards the back of housing 10 to illustrate telephone support member 21 and telephone T. Interior portion 11 comprises a frame indicated generally at 59 having four upright members **60*a*–60*d*. Uprights 60*a*–60*d* may be formed of angle irons. Uprights 60*a*–60*d* are secured together with a number of cross-bars 72 to constitute the frame 59. Cross-bars 72 can be placed in various combinations in a number of possible locations. Cross-bars 72 are horizontally attached between uprights 60*a*–60*d*, as illustrated in FIG. 9 or can be placed at an angle between uprights 60*a*–60*d*. As illustrated, cross-bars 72 have been attached at or near both the top and bottom of frame 59. Cross-bars 72 are attached to uprights 60*a*–60*c*** in any one of several well-known ways, such as with nuts and bolts, rivets or the like.

The telephone support member 21 is attached to the front of frame 59 by securing it to the vertical frame members **60*c* and 60*d*. A number of shelf support bars 66–66″ and 68–68″ provide support for shelves 26 and 24, respectively. Panel 30 may be removably attached to frame 59 below shelf bars 68–68″. A monitor shelf 74 can be further attached between uprights 60*a*–60*d* to support monitor 22. Telephone T is attached to telephone support member 21 through bolts 78**, or some other arrangement.

In the preferred embodiment of the invention, the frame 59 is attached to the floor through the use of base supports 70 and 70′. The base supports 70 and 70′ are formed of angle irons which extend the width of frame 59 and for a length of the front and back, respectively, along the sides of frame 59. Frame 59 is attached to base supports 70 and 70′ and then the base supports 70 and 70′ are attached to the floor (not shown). To enhance security, the base supports 70 and 70′ are attached to the floor with bolts extending through apertures 80 configured in the supports 70 and 70′.

Frame side panels 62 and 62′ are also attached to frame 59, as illustrated in FIGS. 1, 8 and 9. Frame side panels 62 and 62, extend generally between and are attached to uprights **60*b* and 60*c*, and uprights 60*a* and 60*d*, respectively. As illustrated in FIG. 1, a portion of frame side panel 62 (and likewise frame side panel 62′) is exposed to the public and provides parallel surfaces adjacent to telephone T. Frame side panels 62 and 62′ support light fixtures 52′ and 52, respectively. Further, frame side panels 62 and 62′ have small apertures 64 and 64′ over which preferably white translucent covers 76 and 76′ have been secured. Preferably, the same material as used for display panels 48 and 50 is used. When illuminated, light fixtures 52 and 52′ provide back lighting for translucent covers 76 and 76′** to aid telephone users in viewing the telephone T.

As indicated in FIG. 9, the telephone support member 21 includes a standard configuration of pay telephone mounting studs, indicated generally at 78. The support member 21 is preferably composed of a plate, preferably steel, with a thickness in the range of about five-sixteenths to twelve-sixteenths of an inch, preferably about nine-sixteenths of an inch. On the side of support member 21 facing the public, a layer of plastic (not shown) is applied. This plastic layer is made from the same material as plastic layer 52, discussed above. This plastic layer has a thickness in the range of about one-hundredth to six-hundredths of an inch, preferably about three-hundredths of an inch. The arrangement shown in FIG. 9 provides improved deterrence against pay telephone theft because the telephone T is mounted to steel plate 21 which in turn is securely mounted to the floor by the frame 59.

As can be seen in FIGS. 10A–10F, a group of housings 10 of similar design may be positioned relative to each other in a number of different arrangements. This feature is a results from the choice of widths for panels 12 and 20. The ability to cluster a group of housings 10 in novel arrangements is useful since, in many situations, installation of more than one telephone is desired. Arrangement of a group of housings 10 as shown in FIGS. 10A–10F allows varying arrangements of housings 10 while still providing a degree of privacy to telephone callers along with providing different aesthetic appearances. The specific arrangements chosen is a function of the number of housings 10 to be clustered, on the space available, and the preference of the owner or lessor of the telephones.

As seen in FIGS. 10A–10F, the preferred embodiment of housing 10 has five panels 12–20 along with a front portion 91. For convenience, only one housing 10 has been provided with reference numerals to illustrate panels 12–20. Panels 12 and 20 have the same width; for example, a width of 12 and 23/64 inches. Panels 14 and 18 have the same width; for example, a width of 16 and 9/64 inches. The back panel 16 has a width unlike the other panels; for example, a width of 14 and 15/16 inches. These specified lengths for panels 12–20 provide for a front 11 of housing 10 of 20 and 9/32 inches. However, these widths may be varied and still provide a housing which is in accordance with the invention.

More importantly, however, it is the proportions of each of the widths of the panels to each other that allows construction of housings capable of being clustered together in the modular arrangements illustrated in FIGS. 10A–10F. Using the width of panel 16 as a reference, panels 12–20 have the following proportions:

| Panels | Proportion |
|---|---|
| 12 and 20 | 1:0.827 |
| 14 and 18 | 1:1.081 |
| 16 | 1:1 |
| Access Side | 1:1.360 |

Using these proportions, the cluster arrangements of FIGS. 10A–10F may be accomplished.

We claim:

1. A pay telephone housing comprising:

a first panel;

a second panel secured at a first angle relative to said first panel;

a back panel secured at a second angle relative to said second panel;

a third panel secured at a third angle relative to said back panel and generally parallel to said first panel;

a fourth panel secured at a fourth angle relative to said third panel and generally parallel to said second panel, at least one of said angles being an obtuse angle; and an enclosure portion located between said first and said fourth panel including a planar telephone support member, said telephone support member secured within said enclosure portion generally parallel to said back panel.

2. The housing of claim 1 wherein said first panel is substantially equal in width to said fourth panel.

3. The housing of claim 2 wherein said second panel is substantially equal in width to said third panel.

4. The housing of claim 1 wherein said first and said fourth angles are substantially equal.

5. The housing of claim 4 wherein said first and fourth angles are approximately 90 degrees.

6. The housing of claim 4 wherein said second and third angles are substantially equal.

7. The housing of claim 6 wherein said second and said third angles are approximately 135 degrees.

8. The housing of claim 1 wherein said first and fourth panels are substantially equal in width and said second and third panels are substantially equal in width.

9. The housing of claim 1 wherein said five panels are secured together with four molding members each of which secures a respective one of said panels to another of said panels without requiring screws, bolts or other independent fasteners.

10. The housing of claim 9 wherein each of said panels includes a groove configured along at least a portion of their lengths and wherein said molding member includes a projection configured along at least a portion of its length, said projection engaged with said groove.

11. The housing of claim 1 wherein at least one o said panels includes means for slidably engaging an advertising member.

12. The housing of claim 11 wherein said advertising member has a translucent characteristic and wherein the housing includes a light fixture secured within the interior of said housing and adjacent to said advertising member.

13. The housing of claim 1 further including a shelf secured within said enclosure portion below said telephone support member.

14. A pay telephone housing, comprising:

a first panel;

a second panel secured to said first panel at a substantially 90 degree angle;

a back panel secured to said second panel at a substantially 135 degree angle;

a third panel secured to said back panel at a substantially 135 degree angle;

a fourth panel secured to said third panel at a substantially 90 degree angle;

an enclosure portion located between said first panel and said fourth panel including a planar telephone support member secured within said enclosure portion generally parallel to said back panel.

15. The housing of claim 14 wherein said first panel is substantially equal in width to said fourth panel.

16. The housing of claim 15 wherein said second panel is substantially equal in width to said third panel.

17. The housing of claim 14 wherein said first and fourth panels are substantially equal in width and said second and third panels are substantially equal in width.

18. A pay telephone housing comprising:

a plurality of panels secured together defining a partial enclosure, two of said panels being adjacent each other and including an obtuse angle therebetween;

a supporting structure located within said partial enclosure for securing a telephone; and an electronic information display device secured to the housing above said supporting structure.

19. The housing of to claim 18, further, comprising a top panel which extends across the tops of said panels.

20. The housing of claim 18, wherein five of said panels are connected to form an outer portion of the housing.

21. The housing of to claim 20, wherein said panels are at least 72 inches long and 11 inches wide.

22. The housing of to claim 18 two of wherein said panels are secured together with a molding member that secures one panel to another panel.

23. The housing of to claim 22 wherein each of said panels includes a groove configured along at least a portion of its lengths and wherein said molding member includes a projection along at least a portion of its length, said projection engaged with said groove.

24. The housing of to claim 23 wherein at least one of said panels includes means for supporting an advertising member.

25. The housing of to claim 25 wherein said advertising member has a translucent characteristic and wherein the housing includes a light fixture secured within the interior of said housing and adjacent to said advertising member.

26. The housing of claim 18 further including a shelf secured below said telephone supporting means.

27. A pay telephone housing structure comprising:

a plurality of panels configured to form an outer portion of the housing;

an advertisement panel onto which an advertisement has been incorporated;

a panel holder secured to one of said panels configured to receive and slidably engage said advertisement panel, said panel holder and advertisement panel joining together in a registering relationship; and a light fixture secured within the housing adjacent to said advertisement panel.

28. The structure of claim 27 wherein said advertisement panel includes U-shaped members on each side of said advertisement panels and said panel includes tracks for slidably engaging said U-shaped members.

29. The structure of claim 27 wherein said advertisement panel is placed into and removed from said panel holder by entirely sliding said advertisement panel into and out of said panel holder.

30. The structure of claim 27 wherein said light fixture comprises a fluorescent lamp with a length substantially equal to the longest dimension of said advertisement panel.

31. A pay telephone housing, comprising:

(a) at least one housing panel, said panel having a sectioned out portion;

(b) an advertisement panel onto which an advertisement has been incorporated; and (c) a panel holder secured to said housing panel adapted to slidably receive and hold said advertisement panel, said panel holder and advertisement panel joining together in a registering relationship.

32. The housing of claim 31 wherein said advertisement panel includes U-shaped members on each side of said advertisement panel and said panel holder includes tracks for slidably engaging said U-shaped members.

33. The housing of claim 31 further including a light fixture secured within said housing adjacent to said advertisement panel.

34. The housing of claim 33 wherein said light fixture comprises a fluorescent lamp with a length substantially equal to the longest dimension of said advertisement panel.

35. The housing of claim 32 wherein said tracks are members vertically aligned on said housing panel and having a J-shaped cross-section.

36. A pay telephone housing comprising:
a plurality of vertically oriented outer panels; and
a support frame distinct from said outer panels and including:
at least four spaced apart, vertical frame members;
a plurality of cross-bars secured to said vertical frame members effective to secure said vertical frame members in a spaced apart relationship; and
a telephone support member secured to and located between two of said vertical frame members;
said outer panels at least partially enclosing said support frame.

37. The housing of claim 36 additionally including at least one base member secured to one or more of said vertical frame members.

38. The housing of claim 37 wherein said base member is configured to be secured to a floor.

39. The housing of claim 36 wherein four of said vertical frame members are spaced apart in a substantially rectangular relationship.

40. The housing of claim 39 additionally including at least one base member secured to a lower end of two of said vertical frame members and wherein said base member is adapted to be secured to a floor.

41. The housing of claim 40 wherein said telephone support member is a rectangular steel plate.

42. The housing of claim 30 including at least five of said outer panels secured together forming an enclosure portion with said telephone support member located in said enclosure portion.

43. The housing of claim 42 wherein said enclosure portion includes a first slide panel connected to a first one of said outer panels and said support frame and a second side panel connected to a second one of said outer panels and said support frame wherein said telephone support member is located between said first and second side panels.

44. The housing of claim 43 wherein a third one of said outer panels is connected to said first outer panel, a fourth one of said outer panels is connected to said third outer panel and a fifth one of said outer panels is connected to said second and said fourth outer panels.

45. The housing of claim 44 wherein said first and second side panels are connected to said first and second outer panels by a first and second molding members respectively.

46. The housing of claim 45 wherein said third outer panel is connected to said first outer panel by a third molding member and said fifth outer panel is connected to said second outer panel by a fourth molding member.

47. The housing of claim 43 wherein said first and second outer panels include sectioned out portions and including a first and a second advertising panel disposed to said first and second outer panels respectively over said sectioned out portions.

48. The housing of claim 47 additionally including light generating means located adjacent to said first and to said second side panels for illuminating said first and second advertising panels.

49. The housing of claim 30 additionally including an electronic display secured to said support frame.

50. The housing of claim 49 wherein said electronic display is secured to said support frame above said telephone support member.

51. The housing of claim 30 additionally including a monitor shelf secured to said vertical frame members above said telephone support member.

52. A pay telephone housing comprising:
a telephone support member;
five vertically aligned outer panels configured to encompass said telephone support member such that the housing has a horizontal cross-section that is generally hexagonal,
wherein said outer panels are connected together by molding members,
wherein at least one of said molding members includes an curved portion disposed to an outer surface of an adjacent two of said outer panels, a central leg portion connected to said outer curved portion and two inner leg portions connected to said central leg portion and disposed to an inner surface of said two adjacent outer panels,
wherein said inner sides of said two outer panels are configured with inner grooves and said leg portions are configured with projections that are engaged with said inner grooves.

53. A pay telephone housing comprising:
a telephone support member;
five vertically aligned outer panels configured to encompass said telephone support member such that the housing has a horizontal cross-section that is generally hexagonal;
wherein said outer panels are connected together by molding members,
wherein at least one of said molding members includes an curved portion disposed to an outer surface of an adjacent two of said outer panels, a central leg portion connected to said outer curved portion and two inner leg portions connected to said central leg portion and disposed to an inner surface of said two adjacent outer panels,
wherein said outer surfaces of said two adjacent panels are configured with projections that are engaged with said outer grooves and said outer curved portions are configured with projections that are engaged with said outer grooves.

54. A pay telephone housing comprising:
a telephone support member;
five vertically aligned outer panels configured to encompass said telephone support member such that the housing has a horizontal cross-section that is generally hexagonal,
including a support frame located within the housing and to said telephone support member,
additionally including an electronic display secured to said support frame above said support member.

55. The housing of claim 54 wherein said molding member comprises a unitary structure which includes an outer portion disposed to an outer surface of said two outer panels, a central portion interposed between said outer panels and connected at one end to said outer portion, and two legs connected to the other end of said central portion and respectively disposed to an inner surface of each of said two outer panels.

56. The housing of claim 55 wherein said outer surfaces are configured with outer grooves extending at least a portion of the vertical length of said outer panels and said outer portion includes projections engaged with said outer grooves.

57. The housing of claim 54 additionally including to side panels located on either side of said telephone support member and wherein one of said side members is secured to a first one of said outer panels by a first side molding and herein said second side panel is secured to a second one of said outer panels by a second side molding.

58. The housing of claim 57 wherein said side moldings includes an outer portion disposed to an outer surface of said outer panel and an outer surface of said side panel, a central portion interposed between said outer panel and said side panel connected at one end to said outer portion and an inner portion disposed to an inner surface of said outer panel and an inner surface of said side panel and connected to the other end of said central portion.

59. The housing of claim 58 wherein said inner surfaces are configured with grooves extending at least a portion of the vertical length of said outer and said side panels and said inner portion include projections engaged with said grooves.

60. The housing of claim 59 wherein said outer portion is configured with a generally convex cross-section and said inner portions configured with a generally concave cross-section.

61. The housing of claim 60 wherein said side member is configured out of extruded plastic.

* * * * *